US011713510B2

(12) United States Patent
Zhang et al.

(10) Patent No.: US 11,713,510 B2
(45) Date of Patent: Aug. 1, 2023

(54) METHOD FOR FORMING NICKEL PLATED GRAPHENE HOLLOW SPHERE

(71) Applicant: Beijing Institute of Technology, Beijing (CN)

(72) Inventors: Hongmei Zhang, Beijing (CN); Yuxin Ge, Beijing (CN); Hongnian Cai, Beijing (CN); Xingwang Cheng, Beijing (CN); Ying Liu, Beijing (CN); Qunbo Fan, Beijing (CN)

(73) Assignee: Beijing Institute of Technology, Beijing (CN)

( * ) Notice: Subject to any disclaimer, the term of this patent is extended or adjusted under 35 U.S.C. 154(b) by 186 days.

(21) Appl. No.: 17/147,947

(22) Filed: Jan. 13, 2021

(65) Prior Publication Data

US 2021/0222302 A1 Jul. 22, 2021

(30) Foreign Application Priority Data

Jan. 19, 2020 (CN) ..... 202010061309.7

(51) Int. Cl.

| | |
|---|---|
| ***C23C 18/34*** | (2006.01) |
| ***C23C 18/36*** | (2006.01) |
| ***C23C 18/16*** | (2006.01) |

(52) U.S. Cl.

CPC ..... *C23C 18/36* (2013.01); *C23C 18/1639* (2013.01); *C23C 18/1666* (2013.01); *C23C 18/1689* (2013.01); *C23C 18/34* (2013.01)

(58) Field of Classification Search

CPC ..... C23C 18/36; C23C 18/34; C23C 18/1639; C23C 18/1666; C23C 18/1689; C23C 18/1635; C23C 18/1664; C23C 18/54

See application file for complete search history.

(56) References Cited

U.S. PATENT DOCUMENTS

2021/0140050 A1* 5/2021 Derderian ..... C23C 18/1662

FOREIGN PATENT DOCUMENTS

CN 106744902 * 5/2017

OTHER PUBLICATIONS

Yu, et al "Preparation of graphene-enhanced nickel-phosphorus composite films by ultrasonic-assisted electroless plating", Applied Surface Science 435 (2018), pp. 617-625, available online Nov. 22, 2017. (Year: 2017).*

* cited by examiner

*Primary Examiner* — Katherine A Bareford

(74) *Attorney, Agent, or Firm* — Myers Wolin, LLC

(57) ABSTRACT

A method for forming a nickel plated graphene hollow sphere is based on self assembly of graphene under the actions of a rotation force and the van der Waals force, and an electroless nickel plating process performed on the exposed surface of the graphene by means of a hydrothermal method. The method is simple to implement at low cost, and the nickel plated graphene hollow sphere product can be produced with good reproducibility and a high yield. The nickel plated graphene hollow sphere formed by the present method can exhibit good electromagnetic wave absorbing performances of both nickel and graphene, and may have a lower overall density.

8 Claims, 3 Drawing Sheets

METHOD FOR FORMING NICKEL PLATED GRAPHENE HOLLOW SPHERE

CROSS REFERENCE TO RELATED APPLICATION

This U.S. patent application claims foreign priority to Chinese Patent Application No. 202010061309.7, filed on Jan. 19, 2020, the contents of which are herein incorporated by reference.

TECHNICAL FIELD

The present disclosure is related to the preparation of electromagnetic wave absorbing materials, and in particular to a method for forming a nickel plated graphene hollow sphere.

BACKGROUND

Electromagnetic wave absorbing materials, due to their electromagnetic wave absorbing properties, are of great significance for proper work of electronic devices, good environment in which one lives, and improved combat effectiveness of military equipment.

Graphene is a new material emerging in recent years. It is a two-dimensional form of carbon atoms, tightly bound in a hexagonal honeycomb lattice. By virtue of this specific structure, graphene has a very low density and a large specific surface area. Graphene also has a high permittivity, and can attenuate electromagnetic waves due to the relaxation of polarization of the outer electrons caused by the exposure of the chemical bonds on graphene surfaces to electromagnetic fields. Moreover, the graphene products produced by chemical methods generally have a large number of defects and residual functional groups, and electrons of the Fermi energy level tend to be localized. This facilitates absorption and attenuation of the electromagnetic waves. So, graphene can be used as a potential base material for electromagnetic wave absorption, which works through a dielectric loss mechanism.

Nickel is a silvery-white metal, and exhibits good electromagnetic wave absorbing properties. New magnetic metal materials for electromagnetic wave absorption, that are currently developed, are required to have a thin thickness, a light weight, a wide frequency band, strong absorption for electromagnetic wave, etc. However, nickel has a relatively high density, which is a main factor preventing its widespread use in the field of electromagnetic wave absorbing materials.

Magnetic metal hollow particles have a substantially reduced density, which can meet the light weight requirement of the magnetic metal materials intended to be used for electromagnetic wave absorption. Based on this, herein, we propose a composite hollow sphere of graphene and a magnetic metal, which can have both a further reduced density and good electromagnetic wave absorbing properties. The disclosure could have importance to the development of the electromagnetic wave absorbing materials.

SUMMARY

In view of the above, an objective of the present disclosure is to provide a method for forming a nickel plated graphene hollow sphere, which is based on self assembly of graphene having a specific nanostructure as described above under the actions of a rotation force and the van der Waals force, and an electroless nickel plating process performed on the exposed surface of the graphene by means of a hydrothermal method. Accordingly, the method can produce a novel hollow magnetic microsphere with a lower density. Moreover, the method is simple to implement at low cost, and the nickel plated graphene hollow sphere product can be produced with good reproducibility.

The objective of the present disclosure is realized by a method for forming a nickel plated graphene hollow sphere, comprising steps of:

(1) after removing an oxide layer from a surface of a non-powdered metal medium, whose standard electrode potential is lower than that of nickel, by sanding the surface using a sandpaper, immersing the metal medium in an inorganic acid solution to conduct a reaction for at least 3 minutes starting from continuous generation of bubbles on the surface of the metal medium, so as to give an acid treated metal medium after washing and drying; and (2) uniformly dispersing graphene in an electroless plating solution at a concentration of 0.08 to 0.15 g/L, into which the acid treated metal medium is then immersed and into which a reducing agent is added when the temperature of the electroless plating solution has reached 60 to 80° C., so as to conduct a reaction for at least 90 minutes at a stirring speed of 120 to 180 rpm, followed by removal of the unreacted metal medium and collection of a solid powder, which is washed and dried to obtain a nickel plated graphene hollow sphere.

The electroless plating solution consists of a soluble nickel salt, a citrate salt, a pH adjusting agent, and water, and has a pH of 10 to 13. The electroless plating solution has a nickel ion concentration of 0.03 to 0.06 mol/L, and a citrate ion concentration of 0.02 to 0.04 mol/L. The pH adjusting agent includes sodium hydroxide (NaOH), potassium hydroxide (KOH), and aqueous ammonia. The reducing agent is hydrazine hydrate, sodium hypophosphite, or sodium borohydride.

In a preferred embodiment, the inorganic acid solution is a hydrochloric acid (HCl), sulfuric acid ($H_2SO_4$), or nitric acid ($HNO_3$) solution.

In a preferred embodiment, the metal medium is iron or aluminum.

In a preferred embodiment, the metal medium is in the form of a sheet, a block, a rod or a pellet.

In a preferred embodiment, the metal medium is made into a head of a stirring paddle, which is configured to be subjected to the acid treatment according to the step (1) and then to be immersed in the electroless plating solution according to the step (2) to perform the stirring process at the stirring speed of 120 to 180 rpm.

In a further embodiment, the head of the stirring paddle consists of a connecting rod and at least one layer of blades, in the form of a curved flat sheet, mounted on the connecting rod along the length thereof, the or each layer comprising two or more blades disposed symmetrically about the longitudinal axis of the connecting rod.

In a preferred embodiment, the electroless plating solution consists of nickel sulfate hexahydrate, sodium citrate, NaOH, and water, and has a pH of 10 to 13. Further, the concentration of nickel sulfate hexahydrate in the solution may be 8 to 16 g/L. The concentration of sodium citrate in the solution may be 6 to 12 g/L.

In a preferred embodiment, the graphene is added to the electroless plating solution and dispersed for 20 to 40 minutes through ultrasonication and mechanical stirring, so that the graphene is uniformly dispersed in the solution. Further, the ultrasonication power used for the dispersion treatment may be 80 to 120 W. The mechanical stirring may be performed at a stirring speed of 150 to 200 rpm.

In a preferred embodiment, the concentration of hydrazine hydrate in the electroless plating solution is 3 to 6% by mass. In a preferred embodiment, the concentration of sodium hypophosphite in the electroless plating solution is 15 to 25 g/L. In a preferred embodiment, the molar ratio of sodium borohydride to the nickel ions in the electroless plating solution is 1:(10-1000).

The method of the disclosure has several advantages. According to the present method, a hollow sphere structure formed of pure graphene is realized through self assembly of graphene under the actions of a rotation force (mechanical stirring) and the van der Waals force. Meanwhile, an electroless nickel plating process is performed on the exposed surface of the graphene by means of a hydrothermal method while self assembly of the graphene is conducted. During the electroless nickel plating process, the metal present in the plating solution, whose standard electrode potential is lower than that of nickel, is oxidized and thus releases electrons, which are conducted to the graphene. Nickel ions in the plating solution gain the electrons at the surface of the graphene and are reduced to generate auto-catalytic active sites thereon, where metallic nickel deposits or plates out with the aid of a reducing agent to form a nickel plated graphene sphere having a hollow structure. The method is simple to implement at low cost, and the nickel plated graphene hollow sphere product can be produced with good reproducibility and a high yield. The nickel plated graphene hollow sphere formed by the present method can exhibit good electromagnetic wave absorbing performances of both nickel and graphene, and has a lower overall density. Such a material is expected to be promising for applications in fields requiring electromagnetic wave absorption.

DETAILED DESCRIPTION

Embodiments of the present disclosure will now be further described below by reference to the following Examples. Methods employed in the following Examples may be performed in any conventional manners unless otherwise indicated, and starting materials used therein are commercially available unless otherwise indicated.

Reagents and Instruments Used in the Examples:

Dilute hydrochloric acid: a 15% aqueous hydrochloric acid solution;

Dilute sulfuric acid: a 20% aqueous sulfuric acid solution;

Graphene: 99.7% purity, 6 to 11 layers, from SUZHOU TANFENG GRAPHENE TECHNOLOGY Co., Ltd.;

Hydrazine hydrate: analytically pure grade, 80% by mass;

Scanning electron microscope: Quanta-200F from FEI Company.

Figure 5:
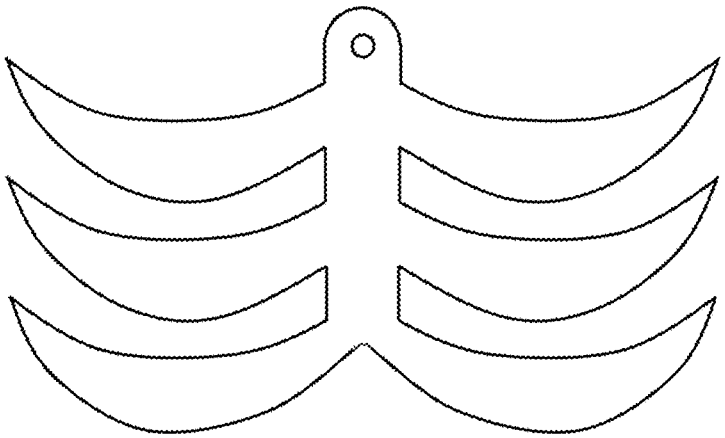
FIG. 5 is a schematic view showing a head of a stirring paddle made of a metal medium according to an embodiment.

The stirring paddle used in the following Examples consists of a connecting rod and three layers of blades mounted on the connecting rod along the length thereof, as shown in FIG. 5. The blade is in the form of a curved flat sheet. Each layer has two blades disposed symmetrically about the longitudinal axis of the connecting rod. The width of each blade is gradually reduced from one end to the other, and the wider end is connected to the connecting rod.

Example 1

A nickel plated graphene hollow sphere was prepared as follows.

An iron sheet was made into a head of a stirring paddle. Surfaces of the head were sanded using a sandpaper to remove an oxide layer thereon. Thereafter, the head was immersed in dilute sulfuric or hydrochloric acid to conduct a reaction for 5 min starting from continuous generation of bubbles on surfaces of the head. An acid treated paddle head was then obtained after washing with deionized water and subsequent drying.

An electroless plating solution, with a pH of 10, consisting of nickel sulfate hexahydrate, sodium citrate, NaOH, and water was prepared with the nickel sulfate hexahydrate concentration of 8 g/L and the sodium citrate concentration of 6 g/L. Graphene was added to the solution at a concentration of 0.08 g/L and was dispersed therein for 20 min through ultrasonication (power at 80 W) and mechanical stirring (150 rpm), so that graphene was uniformly dispersed in the solution. Thereafter, the acid treated head of the stirring paddle was immersed in the solution. When the temperature of the solution had reached 60° C., hydrazine hydrate after hydrolysis with water in a ratio of 1:10 was slowly dropped into the solution, such that the concentration of hydrazine hydrate in the solution was 3% by mass. The mixture was stirred for 90 min at a stirring speed of 120 rpm. The solid product resulting therefrom was collected using a magnet, and was then washed with deionized water and ethanol. The washed solid product was dried in a vacuum oven (at a temperature of 40° C.) to obtain a nickel plated graphene hollow sphere.

Figure 1:
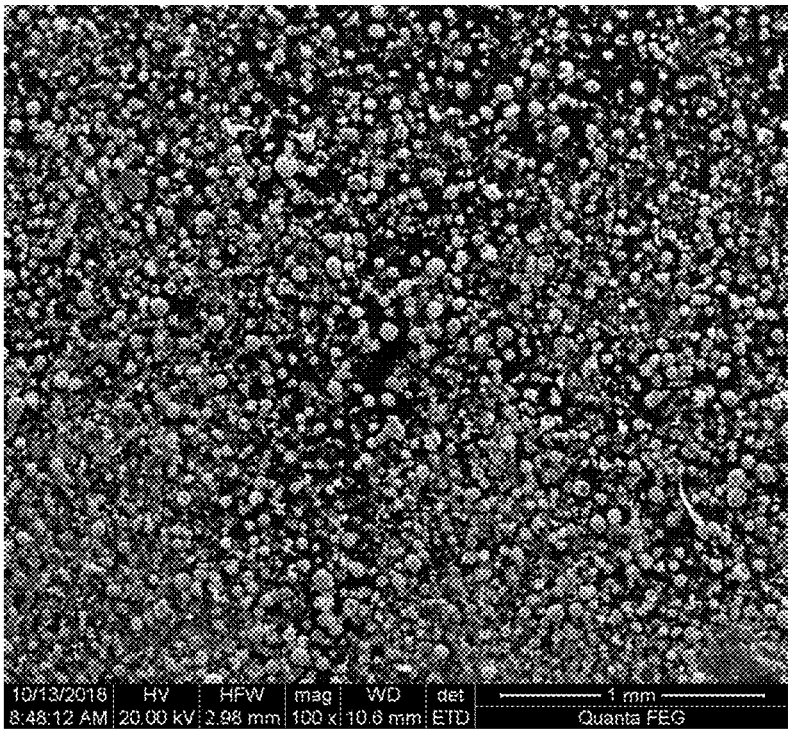
FIG. 1 is a scanning electron microscopic (SEM) image of nickel plated graphene hollow spheres of the present disclosure according to Example 1, magnification 100:1.
Figure 2:
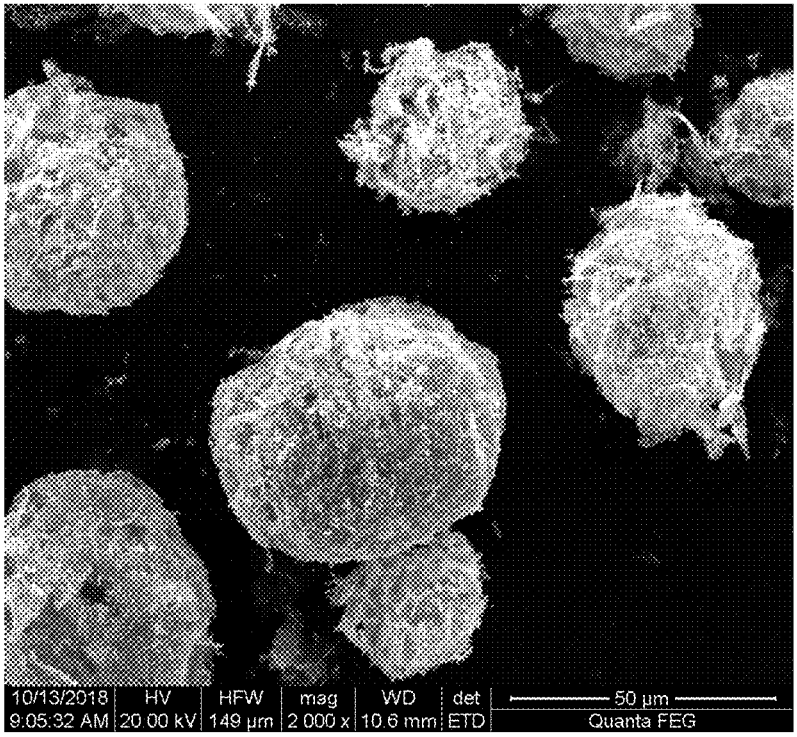
FIG. 2 is an SEM image of nickel plated graphene hollow spheres of the present disclosure according to Example 1, magnification 2000:1.
Figure 3:
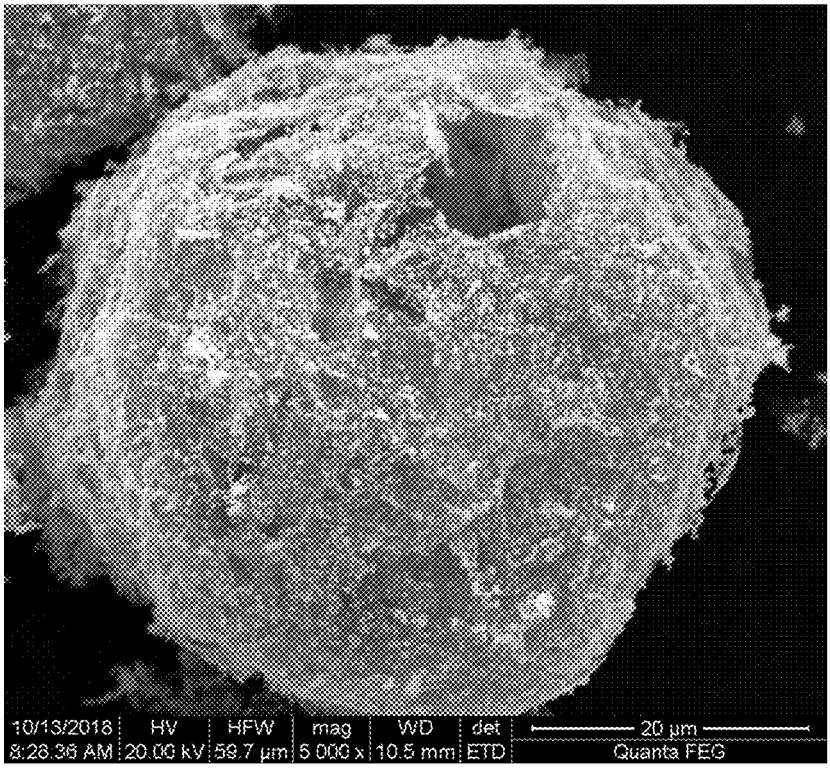
FIG. 3 is an SEM image of nickel plated graphene hollow spheres of the present disclosure according to Example 1, magnification 5000:1.
Figure 4:
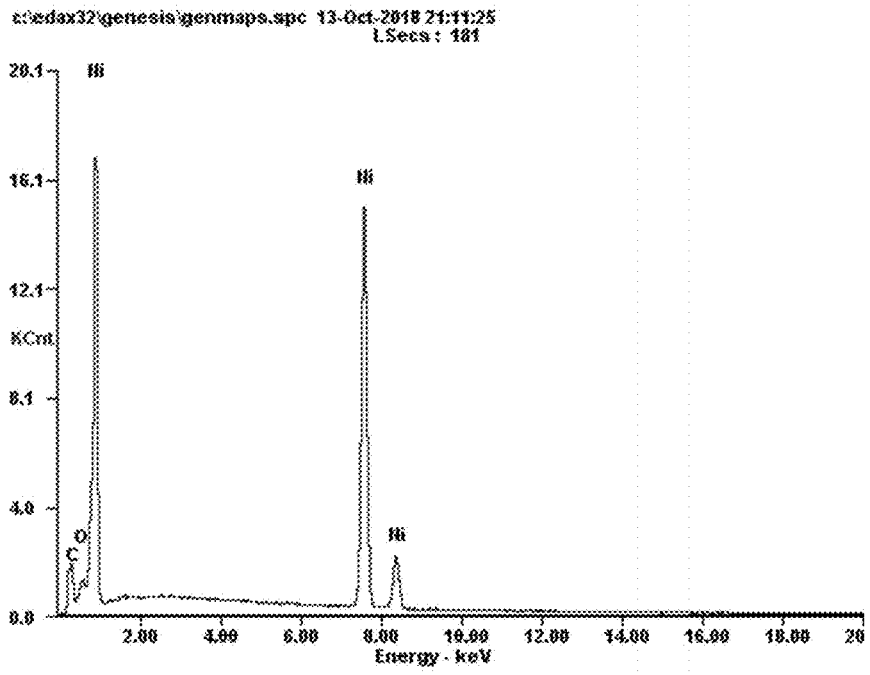
FIG. 4 is an energy dispersive spectroscopy (EDS) of nickel plated graphene hollow spheres of the present disclosure according to Example 1.

FIG. 1 shows that after subjecting graphene to the above treatment, it was converted into spherical particles. This figure also shows that the graphene spherical particles were produced with a high yield and a relatively uniform particle size. It can be seen from FIG. 2 that these graphene spheres were formed through self assembly of graphene sheets dispersed through an ultrasonic treatment, and surfaces of the spheres were covered by fine nickel particles. It can be seen from FIGS. 3 and 4 that the sphere was constituted of a combination of graphene sheets and a nickel plating layer, and had a hollow structure. Moreover, the EDS results indicate that the sphere had a pure nickel plating layer with a very low oxidation level of the nickel.

Example 2

A nickel plated graphene hollow sphere was prepared as follows.

An iron sheet was made into a head of a stirring paddle. Surfaces of the head were sanded using a sandpaper to remove an oxide layer thereon. Thereafter, the head was immersed in dilute sulfuric or hydrochloric acid to conduct a reaction for 3 min starting from continuous generation of bubbles on surfaces of the head. An acid treated paddle head was then obtained after washing with deionized water and subsequent drying.

An electroless plating solution, with a pH of 11, consisting of nickel sulfate hexahydrate, sodium citrate, NaOH, and deionized water was prepared with the nickel sulfate hexahydrate concentration of 12 g/L and the sodium citrate concentration of 9 g/L. Graphene was added to the solution at a concentration of 0.12 g/L and was dispersed therein for 30 min through ultrasonication (power at 100 W) and mechanical stirring (180 rpm), so that graphene was uniformly dispersed in the solution. Thereafter, the acid treated head of the stirring paddle was immersed in the solution. When the temperature of the solution had reached 70° C., hydrazine hydrate after hydrolysis with water in a ratio of 1:10 was slowly dropped into the solution, such that the concentration of hydrazine hydrate in the solution was 4% by mass. The mixture was stirred for 120 min at a stirring speed of 150 rpm. The solid product resulting therefrom was collected using a magnet, and was then washed with deionized water and ethanol. The washed solid product was dried in a vacuum oven (at a temperature of 40° C.) to obtain a nickel plated graphene hollow sphere.

SEM results show that the prepared nickel plating graphene sphere had a hollow structure formed through self assembly of graphene sheets, and the surface of the graphene sphere was covered by fine nickel particles. Moreover, EDS results indicate that the graphene sphere had a pure nickel plating layer with a very low oxidation level of the nickel.

Example 3

A nickel plated graphene hollow sphere was prepared as follows.

An iron sheet was made into a head of a stirring paddle. Surfaces of the head were sanded using a sandpaper to remove an oxide layer thereon. Thereafter, the head was immersed in dilute sulfuric or hydrochloric acid to conduct a reaction for 5 min starting from continuous generation of bubbles on surfaces of the head. An acid treated paddle head was then obtained after washing with deionized water and subsequent drying.

An electroless plating solution, with a pH of 13, consisting of nickel sulfate hexahydrate, sodium citrate, NaOH, and deionized water was prepared with the nickel sulfate hexahydrate concentration of 16 g/L and the sodium citrate concentration of 12 g/L. Graphene was added to the solution at a concentration of 0.15 g/L and was dispersed therein for 40 min through ultrasonication (power at 120 W) and mechanical stirring (200 rpm), so that graphene was uniformly dispersed in the solution. Thereafter, the acid treated head of the stirring paddle was immersed in the solution. When the temperature of the solution had reached 80° C., hydrazine hydrate after hydrolysis with water in a ratio of 1:10 was slowly dropped into the solution, such that the concentration of hydrazine hydrate in the solution was 6% by mass. The mixture was stirred for 150 min at a stirring speed of 180 rpm. The solid product resulting therefrom was collected using a magnet, and was then washed with deionized water and ethanol. The washed solid product was dried in a vacuum oven (at a temperature of 40° C.) to obtain a nickel plated graphene hollow sphere.

SEM results show that the prepared nickel plating graphene sphere had a hollow structure formed through self assembly of graphene sheets, and the surface of the graphene sphere was covered by fine nickel particles. Moreover, EDS results indicate that the graphene sphere had a pure nickel plating layer with a very low oxidation level of the nickel.

Example 4

A nickel plated graphene hollow sphere was prepared as follows.

An iron sheet was made into a head of a stirring paddle. Surfaces of the head were sanded using a sandpaper to remove an oxide layer thereon. Thereafter, the head was immersed in dilute sulfuric or hydrochloric acid to conduct a reaction for 5 min starting from continuous generation of bubbles on surfaces of the head. An acid treated paddle head was then obtained after washing with deionized water and subsequent drying.

An electroless plating solution, with a pH of 11, consisting of nickel sulfate hexahydrate, sodium citrate, NaOH, and deionized water was prepared with the nickel sulfate hexahydrate concentration of 12 g/L and the sodium citrate concentration of 9 g/L. Graphene was added to the solution at a concentration of 0.12 g/L and was dispersed therein for 30 min through ultrasonication (power at 100 W) and mechanical stirring (180 rpm), so that graphene was uniformly dispersed in the solution. Thereafter, the acid treated head of the stirring paddle was immersed in the solution. When the temperature of the solution had reached 70° C., sodium hypophosphite was slowly dropped into the solution, such that the concentration of sodium hypophosphite in the solution was 20 g/L. The mixture was stirred for 120 min at a stirring speed of 150 rpm. The solid product resulting therefrom was collected using a magnet, and was then washed with deionized water and ethanol. The washed solid product was dried in a vacuum oven (at a temperature of 40° C.) to obtain a nickel plated graphene hollow sphere.

SEM results show that the prepared nickel plating graphene sphere had a hollow structure formed through self assembly of graphene sheets, and the surface of the graphene sphere was covered by fine nickel particles. Moreover, EDS results indicate that the graphene sphere had a pure nickel plating layer with a very low oxidation level of the nickel.

Example 5

A nickel plated graphene hollow sphere was prepared as follows.

An iron sheet was made into a head of a stirring paddle. Surfaces of the head were sanded using a sandpaper to remove an oxide layer thereon. Thereafter, the head was immersed in dilute sulfuric or hydrochloric acid to conduct a reaction for 5 min starting from continuous generation of bubbles on surfaces of the head. An acid treated paddle head was then obtained after washing with deionized water and subsequent drying.

An electroless plating solution, with a pH of 11, consisting of nickel sulfate hexahydrate, sodium citrate, NaOH, and deionized water was prepared with the nickel sulfate hexahydrate concentration of 12 g/L and the sodium citrate concentration of 9 g/L. Graphene was added to the solution at a concentration of 0.12 g/L and was dispersed therein for 30 min through ultrasonication (power at 100 W) and mechanical stirring (180 rpm), so that graphene was uniformly dispersed in the solution. Thereafter, the acid treated head of the stirring paddle was immersed in the solution. When the temperature of the solution had reached 70° C., hydrazine hydrate after hydrolysis with water in a ratio of 1:10 was slowly dropped into the solution, such that the concentration of hydrazine hydrate in the solution was 4% by mass. The mixture was stirred for 120 min at a stirring speed of 150 rpm. The solid product resulting therefrom was collected using a magnet, and was then washed with deionized water and ethanol. The washed solid product was dried in a vacuum oven (at a temperature of 40° C.) to obtain a nickel plated graphene hollow sphere.

SEM results show that the prepared nickel plating graphene sphere had a hollow structure formed through self assembly of graphene sheets, and the surface of the graphene sphere was covered by fine nickel particles. Moreover, EDS results indicate that the graphene sphere had a pure nickel plating layer with a very low oxidation level of the nickel.

The above are only preferred embodiments of the present disclosure and are not intended to limit the present disclosure. It will be apparent to those skilled in the art that various modifications, substitutions, and improvements can be made without departing from the spirit and principle of the disclosure.

What is claimed is:

1. A method for forming a nickel plated graphene hollow sphere, comprising:

step (1): after removing an oxide layer from a surface of a non-powdered metal medium, whose standard electrode potential is lower than that of nickel, by sanding the surface using a sandpaper, immersing the metal medium in an inorganic acid solution to conduct an acid treatment for at least 3 minutes starting from continuous generation of bubbles on the surface of the metal medium, and then washing and drying the metal medium so as to give an acid treated metal medium; and step (2): uniformly dispersing graphene in an electroless plating solution at a concentration of 0.08 to 0.15 g/L, immersing the acid treated metal medium in the electroless plating solution containing dispersed graphene, and when the temperature of the electroless plating solution containing dispersed graphene has reached 60 to 80° C., adding a reducing agent into the electroless plating solution containing dispersed graphene; conducting a reaction for at least 90 minutes at a stirring speed of 120 to 180 rpm; then removing the acid treated metal medium that was unreacted after the reaction, and collecting a powder resulting from the reaction; and washing and drying the collected powder to obtain a nickel plated graphene hollow sphere;

wherein, the metal medium is iron or aluminum; and wherein, the electroless plating solution consists of a soluble nickel salt, a citrate salt, a pH adjusting agent, and water with a nickel ion concentration of 0.03 to 0.06 mol/L and a citrate ion concentration of 0.02 to 0.04 mol/L, and has a pH of 10 to 13; wherein, the pH adjusting agent is sodium hydroxide; and wherein, the reducing agent is hydrazine hydrate, sodium hypophosphite, or sodium borohydride.

2. The method according to claim 1, wherein, the inorganic acid solution is a hydrochloric acid, sulfuric acid, or nitric acid solution.

3. The method according to claim 1, wherein, the metal medium is in the form of a sheet, a block, a rod or a pellet.

4. The method according to claim 1, wherein, the metal medium is made into a head of a stirring paddle, and the head of the stirring paddle is subjected to the acid treatment according to the step (1) and then to be immersed in the electroless plating solution containing dispersed graphene according to the step (2) to perform the stirring process at the stirring speed of 120 to 180 rpm.

5. The method according to claim 4, wherein, the head of the stirring paddle consists of a connecting rod and at least one layer of blades, wherein the blades are in the form of a curved flat sheet, and are mounted on the connecting rod along the length thereof, the or each layer comprising two or more blades disposed symmetrically about the longitudinal axis of the connecting rod.

6. The method according to claim 1, wherein, the electroless plating solution consists of nickel sulfate hexahydrate, sodium citrate, sodium hydroxide, and water, and has a pH of 10 to 13; wherein, the concentration of nickel sulfate hexahydrate in the solution is 8 to 16 g/L, and the concentration of sodium citrate in the solution is 6 to 12 g/L.

7. The method according to claim 1, wherein, the graphene is added to the electroless plating solution and dispersed for 20 to 40 minutes through ultrasonication and mechanical stirring, so that the graphene is uniformly dispersed in the solution; wherein, the ultrasonication power used for the dispersion treatment is 80 to 120 W, and the mechanical stirring is performed at a stirring speed of 150 to 200 rpm.

8. The method according to claim 1, wherein, the reducing agent is hydrazine hydrate and its concentration in the electroless plating solution is 3 to 6% by mass; or, the reducing agent is sodium hypophosphite and its concentration in the electroless plating solution is 15 to 25 g/L; or, the reducing agent is sodium borohydride and the molar ratio of sodium borohydride to the nickel ions in the electroless plating solution is 1:(10-1000).

* * * * *